US006157144A

United States Patent [19]

Galt et al.

[11] Patent Number: 6,157,144

[45] Date of Patent: Dec. 5, 2000

[54] SEQUENTIALLY-ACTIVATED MULTIPLE FLASHLAMP LAMPHOUSE SYSTEM AND METHOD

[75] Inventors: John James Galt; James Bernard Pearman, both of Glendale, Calif.

[73] Assignees: Sony Corporation, Japan; Sony Electronics

[21] Appl. No.: 09/234,648

[22] Filed: Jan. 21, 1999

[51] Int. Cl.[7] ..... H05B 37/00

[52] U.S. Cl. ..... 315/323; 362/11; 362/13; 362/362; 362/373

[58] Field of Search ..... 315/323; 362/11, 362/13, 20, 84, 231, 362, 373; 313/483, 484; 353/84

[56] References Cited

U.S. PATENT DOCUMENTS

| | | | |
|---|---|---|---|
| 3,735,111 | 5/1973 | Shaffer | 240/1.3 |
| 3,825,336 | 7/1974 | Reynolds | 355/1 |
| 4,546,420 | 10/1985 | Wheeler et al. | 362/373 |
| 5,392,080 | 2/1995 | Galt et al. | 353/84 |
| 5,779,353 | 7/1998 | Kacheria | 362/373 |

*Primary Examiner*—Don Wong
*Assistant Examiner*—Thuy Vinh Tran
*Attorney, Agent, or Firm*—Fulwider Patton Lee & Utecht, LLP

[57] ABSTRACT

In a system and method for providing a uniform light source for color correction processes, the system includes a plurality of flashlamps for generating a theoretical point light source. The system further includes a power supply for sequentially activating each of the plurality of flashlamps. The system also includes an element for integrating the light generated by the plurality of lamps. The plurality of flashlamps are mounted in the integrating element so as to direct the substantially uniform light generated thereby out from the integrating element.

42 Claims, 2 Drawing Sheets

FIG. 3
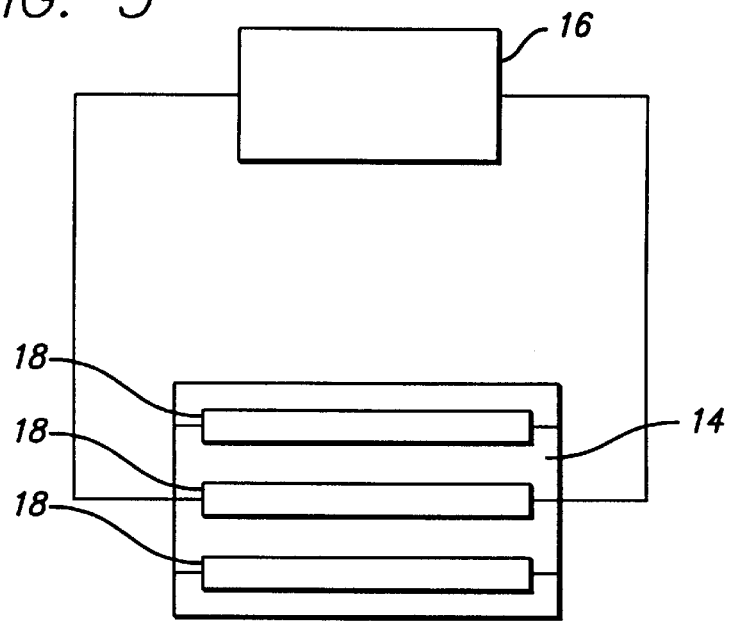
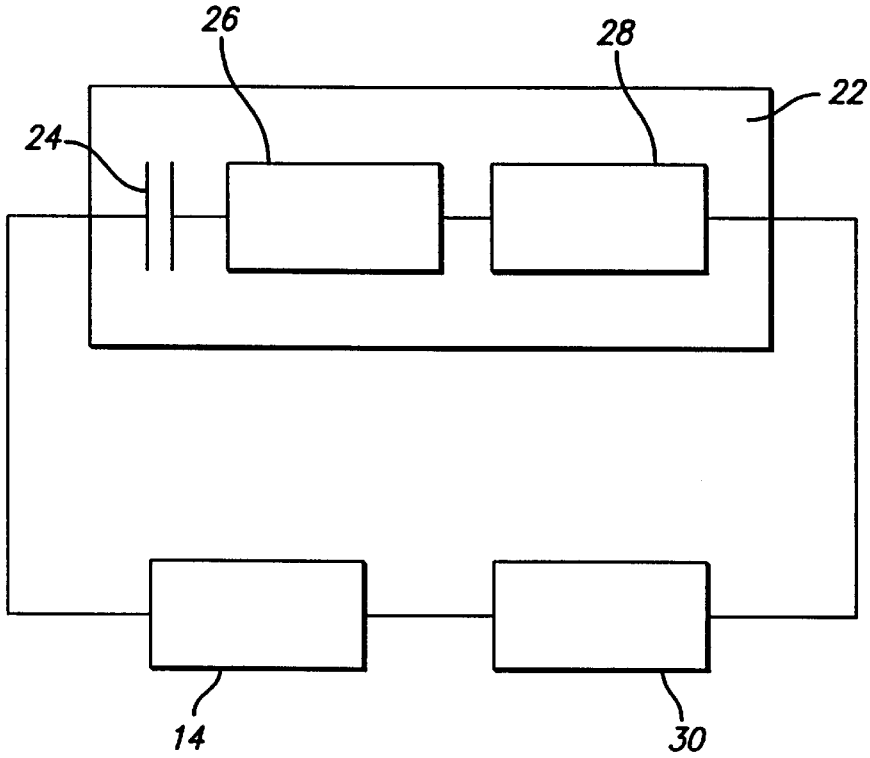
FIG. 4

SEQUENTIALLY-ACTIVATED MULTIPLE FLASHLAMP LAMPHOUSE SYSTEM AND METHOD

BACKGROUND OF THE INVENTION

1. Field of the Invention

This invention relates generally to improvements in providing a uniform light source for color correction for photographic processes, and, more particularly, to a new and improved system and method for providing a high intensity short exposure time light source for high frame rate photography of short duration.

2. Description of the Related Art

It has been known to provide lamphouse systems adapted to enclose a plurality of light sources to generate theoretical point light sources, for high intensity short exposure time light sources for photographic applications. Such light sources provide high light intensity and short exposure duration for high frame rate photography of short duration, for events such as a bullet in flight or video transfer of continuously running motion picture film. Moreover, it has been known to provide such systems wherein the plurality of light sources comprise relatively short arc length flashlamps, which are mounted outside of an integrating element, and wherein the light integrated in the element is directed therefrom. Furthermore, it has been known to provide long arc length flashlamps, including xenon filled flashlamps, as light sources.

However, the light directed from the plurality of the relatively short arc length externally-mounted lamps through the integrating element is relatively less efficient than the light generated by the long arc length flashlamps. Furthermore the long arc length of flashlamps in known system configurations renders them less efficient. Moreover, as the duty cycle of the number of flashes per second of the flashlamps increases, the heat dissipation becomes problematical, and lamp life is greatly reduced.

In view of these considerations, an effective lamphouse system for implementation of a uniform light source is needed, to enable efficient operation thereof. Moreover, such a system is needed to provide an efficient and effective uniform light source operable as a theoretical point light source, and to provide a system wherein flashlamp heat dissipation from an increased number of flashes per second in the duty cycle is accommodated, and lamp life is increased.

Therefore, those concerned with the development and use of improved uniform light source systems and the like have recognized the need for systems and methods for generating an efficient and effective uniform light source, wherein a plurality of flashlamps generate a theoretical point light source, the flashlamps dissipate heat generated by an increased duty cycle, and flashlamp life is increased. Accordingly, the present invention fulfills these needs by providing an efficient and effective uniform light source comprising a plurality of flashlamps in a lamphouse configuration, wherein increased duty cycle flashlamp heat is effectively dissipated and flashlamp life is increased.

SUMMARY OF THE INVENTION

Briefly, and in general terms, the present invention provides a new and improved system and method for providing a uniform light source for color correction processes, adapted to provide a lamphouse with efficient high intensity flash lamps with relatively long life spans.

More particularly, the present invention includes a system for generating a substantially uniform light output. The system includes a plurality of lamps for generating a light output, and an element for sequentially activating each of the plurality of lamps. The system further includes an element for integrating the light generated by the plurality of lamps, so as to enable a substantially uniform light output to be generated upon sequential activation of the plurality of lamps. The plurality of lamps are mounted in the integrating element, so as to direct the substantially uniform light generated thereby out from the integrating element.

The system in accordance with the present invention is further adapted to enable high frame rate photography of short duration, with high light intensity and short exposure duration. It is also adapted to include flashlamps which have a long arc length, and to optimize the long arc length of the flashlamps.

These and other objects and advantages of the invention will become apparent from the following more detailed description, when taken in conjunction with the accompanying drawings of illustrative embodiments.

BRIEF DESCRIPTION OF THE DRAWINGS

FIG. 3 is block diagram of an activating element and a plurality of flashlamps in a light integrating element pursuant to the invention.

FIG. 4 is a block diagram of a power supply, a light integrating element, and a lamp cooling element in accordance with the invention.

DETAILED DESCRIPTION OF THE PREFERRED EMBODIMENTS

Figure 1:
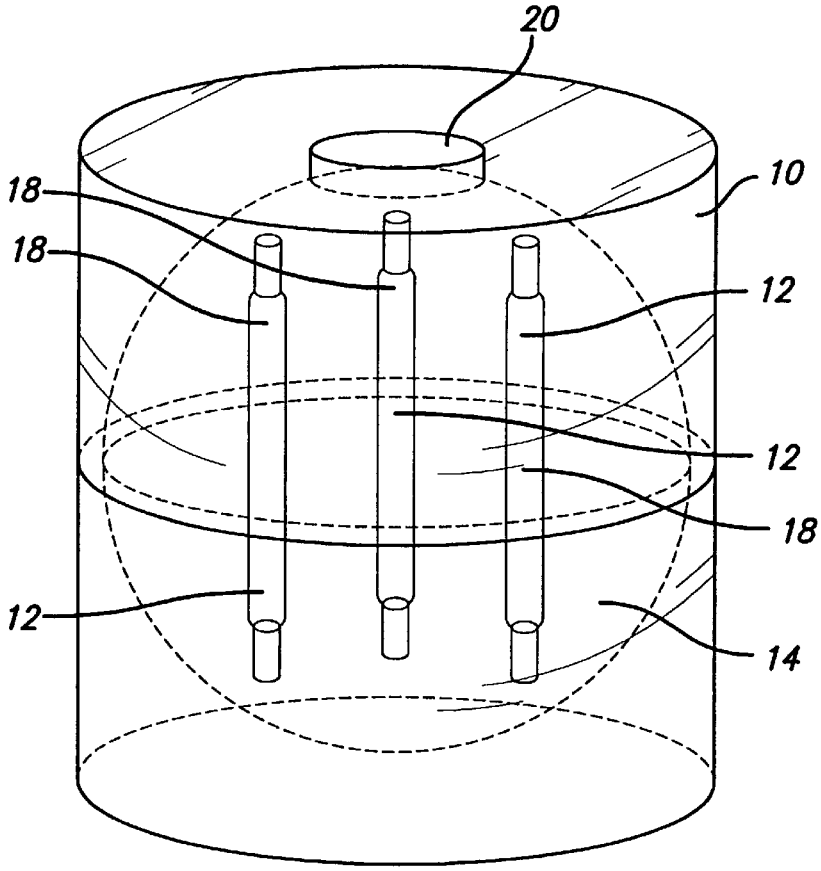
FIG. 1 is an elevational view of a uniform light source system in accordance with the present invention.

The present invention is directed to an improved system and method for providing a uniform light source for color correction, for processes including telecine conversion of film to video, film printing, scanning, and document copying. The improved system and method provides a high intensity short exposure duration light output for high frame rate photography of short duration. The preferred embodiments of the improved system and method are illustrated and described herein by way of example only and not by way of limitation.

Referring now to the drawings, wherein like reference numerals indicate like or corresponding parts throughout the drawing figures, and particularly to FIGS. 1–4, a system 10 for generating a substantially uniform light output includes a plurality of lamps 12, an element 14 for integrating the light generated by each of the plurality of lamps 12, and an element 16 for activating the plurality of lamps 12. The plurality of lamps 12 are mounted in the integrating element 14 so as to direct the substantially uniform light generated thereby out from the integrating element 14. The number of lamps in the plurality of lamps 12 is determined by the particular application and the duty cycle required.

Figure 2:
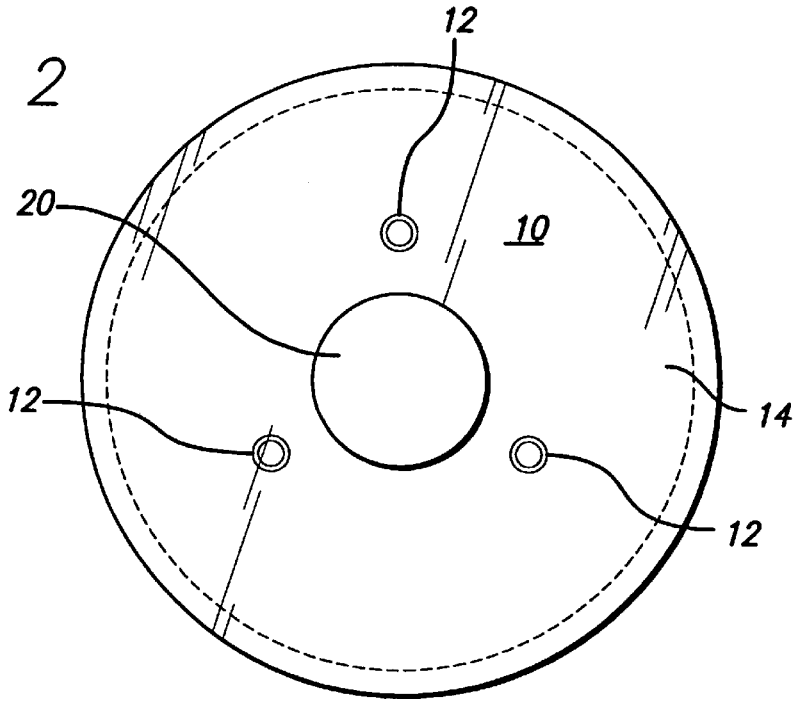
FIG. 2 is a top plan view of the uniform light source system in the practice of the invention.

As illustrated in FIGS. 1–3, each of the plurality of lamps 12 is adapted to generate a high intensity, short exposure time light output. Each of the plurality of lamps 12 preferably comprises a flash discharge lamp which includes an elongated outer tube 18, elements (not shown) in the tube 18 for generating a long arc length beam of light, and a gas under pressure (not shown) in the tube 18, in the presence of which the arc generating elements are operable. The arc generating elements convert electrical energy into light through an arc discharge of stored electrical energy. The arc discharge in each of the plurality of lamps 12 may preferably comprise a substantially long arc discharge.

Each of the plurality of lamps 12 may comprise an xenon arc lamp. The gas under pressure in the tube 18 may comprise for example xenon gas. The light flash generated in each lamp 12 for example may be of short duration, between $10^{-3}$ and $10^{-6}$ second, with a spectral power distribution similar to daylight, and a correlated color temperature of approximately 5400° K. At least one of the plurality of lamps 12 may further include a filter, for filtering so as to provide a specific colorimetric output therefrom. The filter may comprise a filtering color-coating (not shown) applied to the lamp 12. The filtering coating may comprise a substantially narrow interference coating applied to the lamp 12. In another embodiment (not shown), a further lamp may be provided for generating a continuous output light source. Such an embodiment enables combining a continuous output light source with the plurality of flashlamps 12 in the same integrating element 14.

As shown in FIG. 1, the integrating element 14 is adapted to integrate the light generated by each of the plurality of lamps 12, so as to enable a substantially uniform light output to be generated upon activation of the plurality of lamps 12. The substantially uniform light output is generated in the integrating element 14 from each of the plurality of lamps 12 regardless of the location of the plurality of lamps 12 in the integrating element 14. The integrating element 14 is adapted to house the plurality of lamps 12 therein. It is generally sphere-shaped, and includes a port 20 therein for enabling light from the plurality of lamps 12 to exit therefrom. The integrating element 14 is preferably comprised of a material which is adapted to withstand high temperatures, for example 300° C., from the heat generated by the plurality of lamps 12 therein. In another embodiment (not shown) of the integrating element 14, the integrating element 14 is adapted to be sealed.

As seen in FIGS. 3–4, the activating element 16 is adapted to sequentially activate each of the plurality of lamps 12, and to control the light output by controlling the electrical discharge across the lamp arc, by controlling the duration or the level of the electrical arc discharge in each of the plurality of lamps 12. The activating element 16 may comprise a power supply 22, comprising a capacitive discharge power supply which preferably includes a capacitor 24, an element 26 charging the capacitor 24, and an element 28 for controlling the level of charging of the capacitor 24.

Referring to FIG. 4, in a system 10 (not shown) wherein the integrating element 14 is sealed, the system 10 may further include an element 30 for cooling each of the plurality of lamps 12, adapted to circulate a cooling media around each of the plurality of lamps 12. The cooling media may comprise a cooling fluid.

In accordance with the present invention, the system 10, including the plurality of sequencing flash lamps 12 and the integrating generally sphere-shaped element 14, is adapted to provide a uniform light source for color correction for processes including telecine conversion of film to video, film printing, scanning, and document copying. The system 10 is adapted to provide high intensity flash lamps 12 with relatively long life spans. It includes multiple lamps 12 sequentially timed through a capacitive discharge power supply 22. The integrating sphere 14 provides a housing for the lamps 12, which enables consistent light output regardless of the physical location of the lamps 12 therein. The integrating sphere 14 may be sealed, and a cooling fluid 30 may be circulated around the lamps 12.

Further in accordance with the present invention, the system 10, including the plurality of flash lamps 12 and the integrating sphere 14, provides high intensity short exposure time light for photographic applications. It provides high frame rate photography of short duration, with high light intensity and short exposure duration, for events such as a bullet in flight or video transfer of motion picture film running continuously.

The system 10, including the integrating sphere 14 and the plurality of flashlamps 12 therein, is further adapted to optimize the long arc length of the preferred xenon arc lamps 12 with the integrating sphere 14, using multiple lamps 12 sequentially timed through the capacitive discharge. It is particularly useful in telecine applications or film inspection where it is desirable to view images in a high speed shuttle with a minimum of blur.

Moreover, in the present invention, the system 10 also enables filtering of individual lamps to provide specific colormetric output. For example, a sequence of the plurality of lamps 12 may be used to generate sequential exposure color images, with a single detector monochrome video camera.

Furthermore, the system 10 pursuant to the present invention is adapted to provide multi-spectral imaging, by including a narrow bandwidth interference filter coating on individual ones of the plurality of lamps 12.

It will be apparent from the foregoing that, while particular forms of the invention have been illustrated and described, various modifications can be made without departing from the spirit and scope of the invention. Accordingly, it is not intended that the invention be limited, except as by the appended claims.

What is claimed is:

1. A system for generating a substantially uniform light output, comprising:

means for generating a light output, comprising a plurality of lamps;

means for activating the generating means, comprising means for sequentially activating each of the plurality of lamps; and means for integrating the light generated by the plurality of lamps, so as to enable a substantially uniform light output to be generated upon sequential activation of the plurality of lamps, adapted to enable the substantially uniform light output to be generated upon sequential activation of the plurality of lamps regardless of the location of the plurality of lamps in the integrating means, comprising means for housing the plurality of lamps, which housing means are generally sphere-shaped and hollow, including a port therein for enabling light from the plurality of lamps to exit from the housing;

wherein the plurality of lamps are housed in the housing means so as to integrate the light generated by the plurality of lamps into a substantially uniform light output and direct the substantially uniform light output generated thereby out from the housing means.

2. The system of claim 1, wherein a plurality of lamps comprises a plurality of flash discharge lamps.

3. The system of claim 2, wherein the generating means further comprises a continuous output light source.

4. The system of claim 2, wherein each of the plurality of flash discharge lamps includes means for generating a substantially high intensity short exposure time light output.

5. The system of claim 2, wherein each flash discharge lamp includes means for converting electrical energy into light through an arc discharge of stored electrical energy in the presence of gas under pressure.

6. The system of claim 5, wherein the activating means comprises means for controlling the arc discharge.

7. The system of claim 6, wherein the controlling means comprise means for controlling the duration of the electrical discharge.

8. The system of claim 6, wherein the controlling means include a capacitor, means for charging the capacitor, and means for controlling the level of charging of the capacitor.

9. The system of claim 5, wherein each arc discharge is a substantially long arc discharge.

10. The system of claim 9, wherein each flashlamp comprises an xenon arc lamp.

11. The system of claim 5, wherein the gas comprises xenon gas.

12. The system of claim 1, further comprising means for cooling each of the plurality of lamps, adapted to circulate a cooling media around the lamps.

13. The system of claim 12, wherein the cooling medium comprises a cooling fluid.

14. The system of claim 1, further comprising means for filtering at least one of the plurality of lamps so as to provide a specific colorimetric output therefrom.

15. The system of claim 14, wherein the filtering means comprises a color-coating applied to the lamp.

16. The system of claim 14, wherein the filtering means comprises a substantially narrow interference coating applied to the lamp.

17. The system of claim 1, further comprising means for supplying power to the plurality of lamps.

18. The system of claim 17, wherein the power supplying means comprise a capacitive discharge power supply.

19. The system of claim 1, wherein the housing is adapted to be sealed.

20. A method of generating a substantially uniform light output, in a system which includes means for generating a light output, comprising a plurality of lamps, means for activating the generating means, comprising means for sequentially activating each of the plurality of lamps, and means for integrating the light generated by the plurality of lamps, so as to enable a substantially uniform light output to be generated upon sequential activation of the plurality of lamps, adapted to enable the substantially uniform light output to be generated upon sequential activation of the plurality of lamps regardless of the location of the plurality of lamps in the integrating means, comprising means for housing the plurality of lamps, which housing means are generally sphere-shaped and hollow, including a port therein for enabling light from the plurality of lamps to exit from the housing, wherein the plurality of lamps are housed in the housing means so as to integrate the light generated by the plurality of lamps into a substantially uniform light output and direct the substantially uniform light output generated thereby out from the housing means, wherein the method comprises the steps of:

activating the activating means so as to activate the light output generating means;

activating the sequentially activating means so as to sequentially activate each of the plurality of lamps; and integrating the light generated by the plurality of lamps in the sequentially activating means, in the generally sphere-shaped and hollow housing means, so as to generate a substantially uniform light output.

21. The method of claim 20, wherein the integrating step comprises integrating the light generated by the plurality of lamps in the housing means.

22. The method of claim 20, wherein the integrating step comprises integrating the light generated by the plurality of lamps in the housing means, regardless of the location of the plurality of lamps in the integrating means.

23. The method of claim 20, wherein the plurality of lamps comprise a plurality of flash discharge lamps, and the integrating step comprises integrating the light generated by the plurality of flash discharge lamps in the housing means.

24. The method of claim 23, wherein the generating means further comprises a continuous output light source, and the activating steps further comprises activating the continuous output light source.

25. The method of claim 23, wherein each of the plurality of flash discharge lamps includes means for generating a substantially high intensity, substantially short exposure time, light output, and the activating step further comprises activating the substantially high intensity short exposure time light output in each of the flash discharge lamps.

26. The method of claim 23, wherein each flash discharge lamp comprises means for converting electrical energy into light through an arc discharge of stored electrical energy in the presence of gas under pressure, and the activating step further comprises activating the converting means in each of the flash discharge lamps so as to convert electrical energy into light through the arc discharge of electrical energy in the presence of gas under pressure.

27. The method of claim 26, wherein the activating means comprise means for controlling the arc discharge, and the activating step further comprises controlling the arc discharge in each of the flash discharge lamps through the controlling means.

28. The method of claim 27, wherein the controlling means comprises means for controlling the duration of the electrical discharge, and the activating step further comprises controlling the arc discharge in each of the flash discharge lamps through the electrical discharge duration controlling means.

29. The method of claim 27, wherein the controlling means comprises a capacitor, means for charging the capacitor, and means for controlling the level of charging of the capacitor, and the actuating step further comprises controlling the xenon arc discharge in each of the flash discharge lamps through the capacitor, the capacitor charging means, and the capacitor charging level controlling means.

30. The method of claim 26, wherein each arc discharge is a substantially long arc discharge, and the activating step further comprises converting the substantially long arc discharge in each of the flash discharge lamps through the converting means.

31. The method of claim 30, wherein the flashlamp comprises an xenon arc lamp, and the activating step further comprises converting the xenon arc discharge in each of the xenon arc lamps through the converting means.

32. The method of claim 26, wherein the gas comprises xenon gas, and the activating step further comprises converting the electrical energy arc discharge in the presence of xenon gas.

33. The method of claim 20, wherein the system further comprises means for cooling each of the plurality of lamps, adapted to circulate a cooling media around the lamps, and the method further comprises the step of cooling each of the plurality of lamps with the cooling means.

34. The method of claim 33, wherein the cooling media comprises a cooling fluid, and the cooling step comprises cooling each of the plurality of lamps with a cooling fluid.

35. The method of claim 30, wherein the system further comprises means for filtering at least one of the plurality of lamps so as to provide a specific colorimetric output therefrom, and the method further comprises the step of filtering at least one of the plurality of lamps with the filtering means so as to provide a specific calorimetric output therefrom.

36. The method of claim 28, wherein the filtering means comprises a color-coating applied to the lamp, and the filtering step comprises filtering at least one of the plurality of lamps through a color-coating applied thereto.

37. The method of claim 35, wherein the filtering means comprises a substantially narrow interference coating applied to the lamp, and the filtering step comprises filtering at least one of the plurality of lamps through a substantially narrow interference coating applied thereto.

38. The method of claim 20, wherein the system further comprises means for supplying power to the plurality of lamps, and the method further comprises the step of supplying power to the plurality of lamps with the supplying means.

39. The method of claim 38, wherein the power supplying means comprises a capacitive discharge power supply, and the method further comprises the step of supplying power to the plurality of lamps through the capacitive discharge power supply.

40. The method of claim 20, wherein the integrating step comprises integrating the light generated by the plurality of lamps in the generally sphere-shaped housing.

41. The method of claim 40, wherein the housing is adapted to be sealed, and the integrating step comprises integrating the light generated by the plurality of lamps in the sealed housing.

42. The method of claim 40, wherein the generally sphere shaped housing includes a port therein for enabling light from the plurality of lamps to exit from the housing, and the method further comprises the steps of enabling light from the plurality of lamps to exit through the port in the housing.

* * * * *